US005482163A

United States Patent [19]

Hoffman

[11] Patent Number: 5,482,163

[45] Date of Patent: Jan. 9, 1996

[54] LAST EVENT INDICATOR

[76] Inventor: Kenneth L. Hoffman, 32591 Flanders St. NE., Cambridge, Minn. 55008

[21] Appl. No.: 364,083

[22] Filed: Dec. 27, 1994

[51] Int. Cl.[6] ..... B65D 83/04

[52] U.S. Cl. ..... 206/534; 206/459.1; 206/528; 116/309

[58] Field of Search ..... 206/528, 530, 206/533, 534, 459.1; 116/309, 317; 40/306

[56] References Cited

U.S. PATENT DOCUMENTS

| | | | |
|---|---|---|---|
| 2,625,131 | 1/1953 | Sturhahn | 116/121 |
| 3,424,336 | 1/1969 | Perez et al. | 206/459.1 |
| 3,818,858 | 6/1974 | Kramer et al. | 116/309 |
| 3,996,879 | 12/1976 | Walton | 116/121 |
| 4,207,982 | 6/1980 | Maxwell et al. | 206/459.1 |
| 4,268,986 | 5/1981 | Piana | 40/316 |
| 4,419,016 | 12/1983 | Zoltan | 368/10 |
| 4,802,438 | 2/1989 | DeJonge | 116/308 |
| 4,860,684 | 8/1989 | Al-Harbi | 116/308 |
| 4,877,119 | 10/1989 | Hosking | 206/459 |
| 4,913,083 | 4/1990 | Valvo et al. | 206/534 |
| 4,951,596 | 8/1990 | Wallace, Jr. | 116/321 |
| 5,011,032 | 4/1991 | Rollman | 206/534 |
| 5,046,605 | 9/1991 | Levrant | 206/459.1 |

*Primary Examiner*—David T. Fidei
*Attorney, Agent, or Firm*—Westman, Champlin & Kelly

[57] ABSTRACT

A last event indicator apparatus includes a cylindrical support having a longitudinal axis, an outer surface and a tapered flange structure. The tapered flange structure has a first end having a first diameter and a second end having a second diameter that is greater than the first diameter of the first end. An expandable indicator ring is disposed over the outer surface. The indicator ring is axially displaceable along the longitudinal axis to engage the tapered flange structure and cause expansion of the indicator ring. The expandable indicator ring is rotatable about the longitudinal axis over the outer surface to each of a plurality of selected positions.

18 Claims, 4 Drawing Sheets

LAST EVENT INDICATOR

BACKGROUND OF THE INVENTION

The present invention relates to a last event indicator. In a preferred embodiment, the present invention relates to a medicine container for pills, capsules and the like, the present invention providing an indication as to whether a dose should be taken.

Compliance to medication prescriptions wherein medicine must be taken in periodic intervals is an ongoing problem. Many types of time indicators have been developed for use with medicine bottles. However, to date there has not been any standard design which has been readily accepted by medicine container manufacturers. Commonly, these designs require significant container remolding, while others require many parts which either must be assembled together to achieve a workable device or simply do not work with child proof caps now required on medication containers.

SUMMARY OF THE INVENTION

A last event indicator apparatus includes a cylindrical support having a longitudinal axis, an outer surface and a tapered flange structure. The tapered flange structure has a first end having a first diameter and a second end having a second diameter that is greater than the first diameter of the first end. An expandable indicator ring is disposed over the outer surface. The indicator ring is axially displaceable along the longitudinal axis to engage the tapered flange structure and cause expansion of the indicator ring. The expandable indicator ring is rotatable about the longitudinal axis over the outer surface to each of a plurality of selected positions.

In a preferred embodiment, a protrusion is formed on the cylindrical support remote from the tapered flange structure. The protrusion functions as a pointer and with corresponding notches formed on the indicator ring defines the plurality of selected positions. Suitable indicia is placed on the indicator ring and identifies each notch as a particular event.

DETAILED DESCRIPTION OF THE PREFERRED EMBODIMENTS

Figure 1:
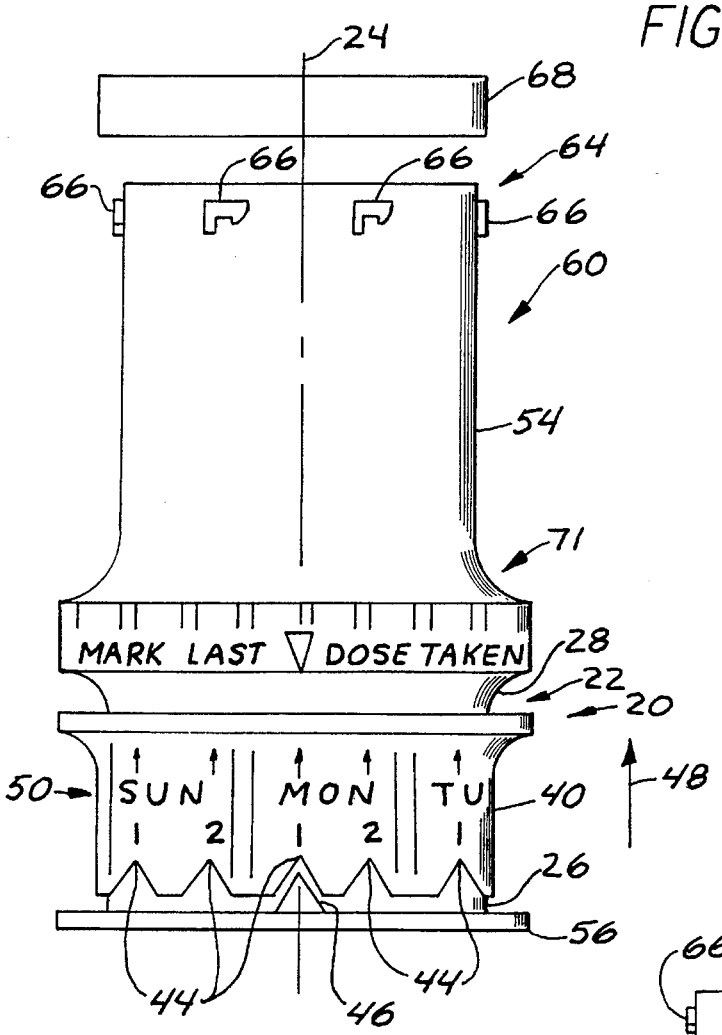
FIG. 1 is a side elevational view of a first embodiment of the present invention.
Figure 2:
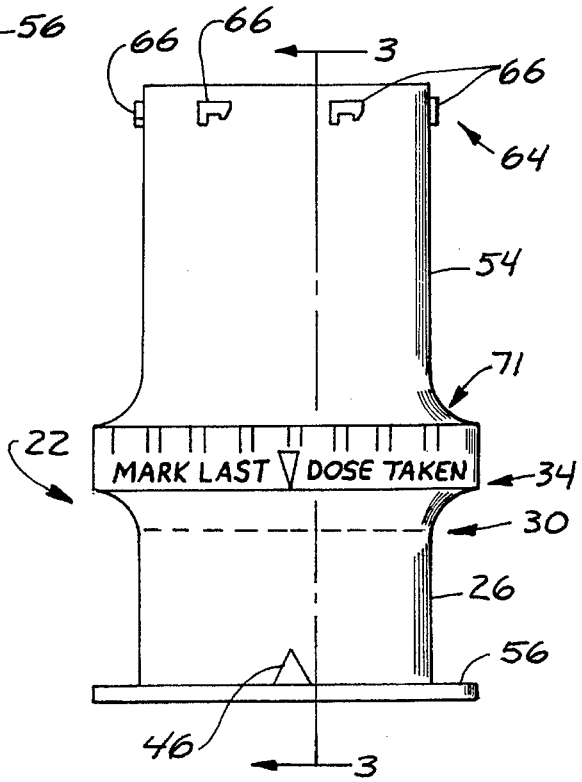
FIG. 2 is a side elevational view of the first embodiment with an indicator ring removed.
Figure 3:
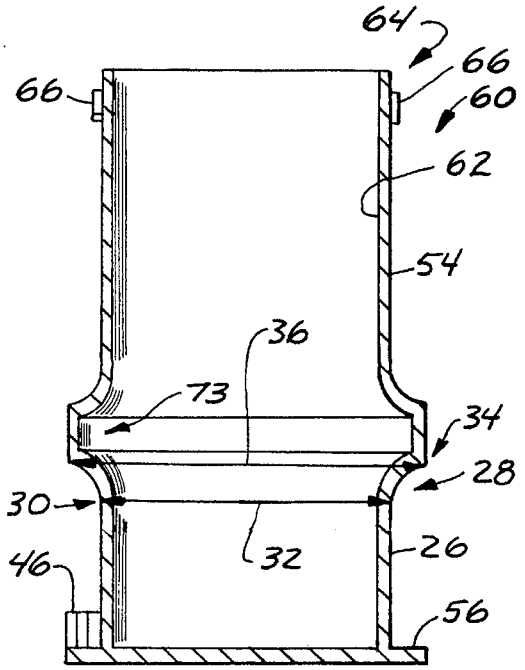
FIG. 3 is a sectional view taken along lines 3—3 of FIG. 2.

FIG. 1 illustrates a last event indicator apparatus of the present invention at 20. The apparatus 20 includes a cylindrical support 22 having a longitudinal axis 24 and an outer surface 26 having a tapered flange structure 28. The tapered flange structure 28 has a first end 30 having a first diameter 32 (FIG. 3). As illustrated in FIG. 2, the first end 30 of the tapered flange structure 28 is preferably integrally joined with the outer surface 26 to provide a smooth transition. A second end 34 of the tapered flange structure 28 has a second diameter 36 that is greater than the first diameter 32.

Referring back to FIG. 1, an expandable indicator collar or ring 40 is disposed over the outer surface 26. The indicator ring 40 is displaceable along the longitudinal axis 24 to engage the tapered flange structure 28 which causes expansion of the indicator ring 40. The expandable indicator ring 40 is also rotatable about the longitudinal axis 24 over the outer surface 26 to each of a plurality of selected positions coinciding with notches 44 provided in the expandable ring 40. A pointer 46 is provided on the cylindrical support 22 and selectively engages each of the notches 44 on the expandable indicator ring 40. By pulling on the expandable indicator ring 40 in the direction indicated by arrow 48, the indicator ring 40 expands so that the ring 40 can be rotated about the longitudinal axis 24 in order that another notch of the plurality of notches 44 is aligned with the pointer 46. The expandable indicator ring 40 can then be released so that the selected notch engages the pointer 46. As illustrated, suitable indicia 50 is provided on the ring 40 that when aligned with the pointer 46 indicates when the last event cccurred. Contraction of the expandable indicator ring 40 upon the flange structure 28 imparts a downward force so that the expandable indicator ring 40 engages the pointer 46 and is retained in the selected position.

Figure 4:
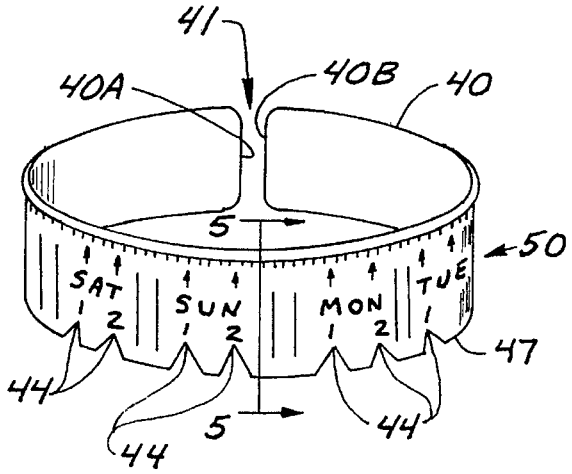
FIG. 4 is a perspective view of the indicator ring of the first embodiment.
Figure 5:
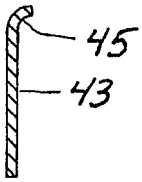
FIG. 5 is a sectional view of the indicator ring taken along lines 5—5 of FIG. 4.

FIG. 4 provides a perspective view of the indicator ring 40. In the embodiment illustrated, the indicator ring 40 is a split ring having ends 40A and 40B separated from each other with a suitable slot or gap 41. The indicator ring 40 is made of a resilient material such as plastic that can expand and then contract to return to its original shape. Preferably, as also illustrated in FIG. 5, the indicator ring 40 is formed having a smooth cylindrical body 43 with an integral outwardly extending flange or lip 45. The lip 45 allows the indicator ring 40 to be grasped and displaced axially in order to engage the tapered flange structure 28 and rotated to a new position. As stated above, the indicator ring 40 includes notches 44 periodically spaced to define the selected positions. The notches 44 extend from a perimeter edge 47 of the indicator ring 40 and toward the lip 45. The notches 44 are adapted to cooperate with the shape of the pointer 46.

In a preferred embodiment, the present invention is well suited to indicate compliance of a patient to a medication prescription. In particular, the present invention provides an indication as to whether the patient has taken a dose of medication required in a reoccurring time period. In the embodiment illustrated, the indicia 50 represents doses taken during a week with multiple doses taken during each day. Of course, both the recurring time period and the number of doses taken can be adjusted and represented as notches 44 on the ring 40 as desired. Furthermore, a particular advantage of the present is that the indicator ring 40 can be easily removed by expanding the ends 40A and 40B a sufficient distance so that the ring 40 can be replaced with another indicator ring, not shown, having indica representing a different medication prescription. In this manner, a user need not obtain a different container for the medication when the prescription changes, but rather, only an appropriate indicator ring 40 having suitable indicia.

It should be understood that although the present invention is described as indicating whether a particular dosage has been taken, modification of indicia present on the present invention can be made easily to indicate when the next dosage should be taken. This could be every four to six hours or the like, daily or semi-daily, or some other periodic time period. Thus, while the present invention is described in conjunction with days of the week, it should be understood that; this is merely illustrative in that numerals, letters, hours, half-hours or other indicia could be utilized without departing from the scope of the present invention.

In the first embodiment of the present invention, the cylindrical support 22 is integrally formed with a second cylindrical section 54 and a bottom plate 56 to form a container 60 having an inner cavity 62 suitable for holding medicine. An upper end 64 of the container 60 has suitable child-proof locking hooks 66 or other known retaining means to cooperate with a removable cap 68.

As illustrated, the second cylindrical section 54 is integrally joined to the cylindrical support 22 to form a second tapered area 71. It should be understood that the second cylindrical section 54 can have a diameter equal to the second diameter 36 of the tapered flange structure 28 and thereby eliminate the second tapered area 71, if desired.

Figure 12:
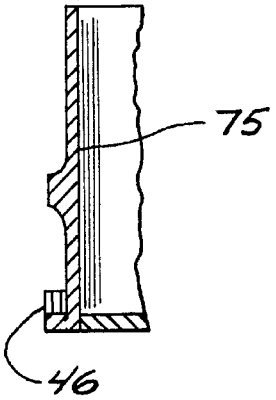
FIG. 12 is a partial sectional view of a medication container of the present invention with an indicator ring removed.

The cylindrical support 22 is preferably formed from plastic using known manufacturing techniques. Although illustrated in FIG. 3 with the tapered flange structure 28 having an inner annular recess 73, it should be understood a smooth cylindrical inner cavity 75 can also be formed as illustrated in the embodiment of FIG. 12.

Figure 6:
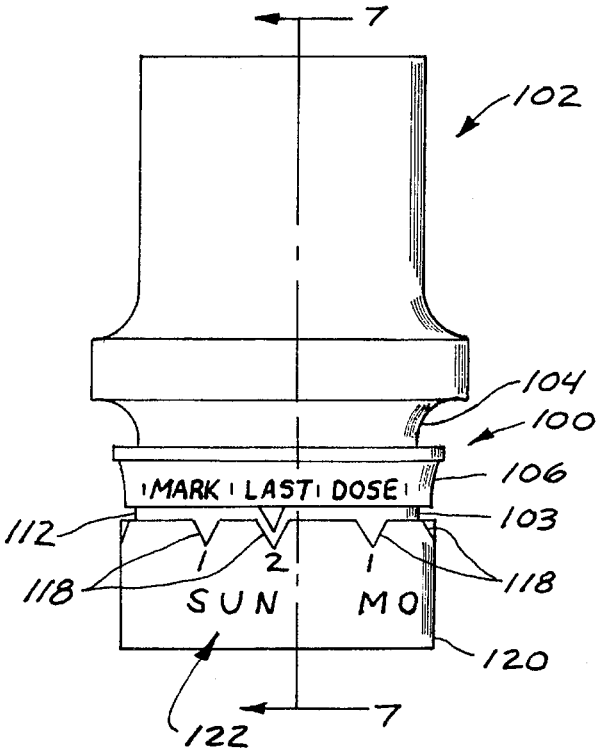
FIG. 6 is a side elevational view of a second embodiment of the present invention.
Figure 7:
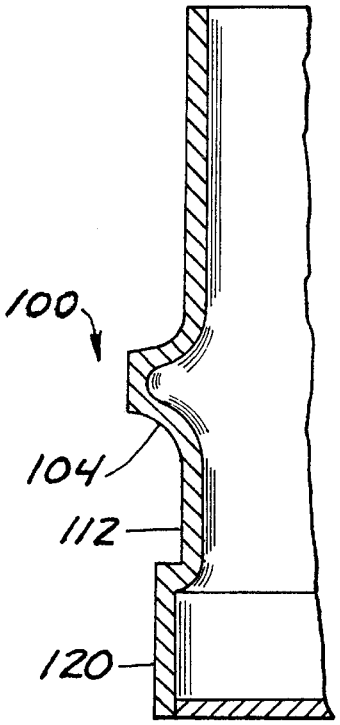
FIG. 7 is a partial sectional view taken along line 7—7 of FIG. 6 with an indicator ring removed.
Figure 8:
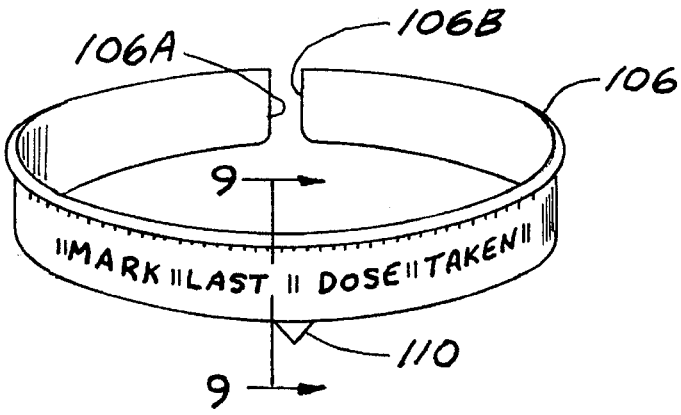
FIG. 8 is perspective view of the indicator ring of the second embodiment.
Figure 9:
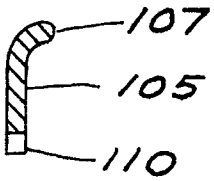
FIG. 9 is a sectional view of the indicator ring taken along lines 9—9 of FIG. 8.

A second embodiment of the present invention is illustrated in FIG. 6 at 100. Embodied also as a container 102, the apparatus 100 includes a cylindrical support 103 having a tapered flange structure 104 and an axially displaceable and rotatable indicator ring 106. Referring also to FIG. 8, the indicator ring 106 includes an extending pointer 110. With axial displacement of the indicator ring 106 over a surface 112 of the cylindrical support 103, the indicator ring 106 engages the tapered flange structure 104 and expands. Preferably, the indicator ring 106 is formed as a split-ring having separated ends 106A and 106B. The indicator ring 106 has a cylindrical body 105 and an extending lip 107. The indicator ring 106 can be rotated over the outer surface 112 so that the pointer 110 selectively engages notches 118 formed in a stop collar 120. Preferably, as illustrated in FIG. 7, the stop collar 120 is integrally joined to the cylindrical support 103. Suitable indicia 122 is placed on the stop collar 120, which with the pointer 110 indicates the last dose taken by the user. Of course, if the indica 122 does not require the entire circumference of the cylindrical support 103, the stop collar 120 need only be a portion sufficient or long enough to provide the desired amount of spaced-apart notches 118.

Figure 10:
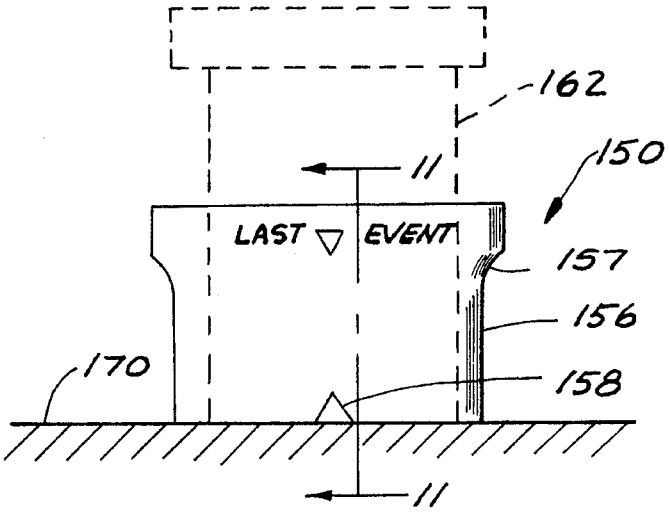
FIG. 10 is a side elevational view of a third embodiment of the present invention with an indicator ring removed.
Figure 11:
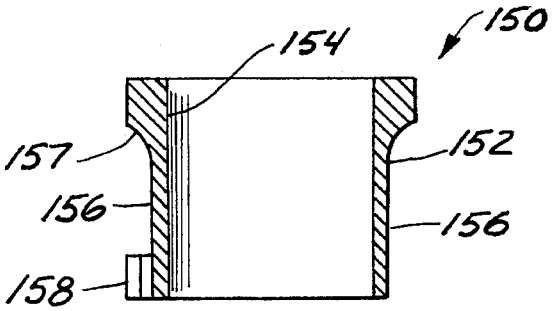
FIG. 11 is a sectional view taken along lines 11—11 of FIG. 10.

A third embodiment of the present invention illustrated at 150 in FIGS. 10 and 11. The last event indicator apparatus 150 includes a cylindrical support 152 having a inner bore 154 extending therethrough. A suitable indicator ring such as ring 40 illustrated in FIGS. 1 and 4 is disposed over an outer surface 156 and selectively engages a tapered flange structure 157 and a pointer 158 in the manner described above. The last event indicator apparatus 150 is particularly well suited for use with known medicine containers wherein the bore 154 has a diameter sufficient to encircle the medicine container 162 when placed on a support surface 170.

Although the present invention has been described with reference to preferred embodiments, workers skilled in the art will recognize that changes may be made in form and detail without departing from the spirit and scope of the invention. In addition, although the present invention has been particularly described and embodied as and for use with medication containers, it is also well suited for tracking other occurrences such as goals scored in sporting events and adding salt to a water softener.

What is claimed is:

1. A last event indicator apparatus comprising:

a cylindrical support having a longitudinal axis and an outer surface and a tapered flange structure, the tapered flange structure having a first end with first diameter and a second diameter that is greater than the first diameter; and an expandable indicator ring disposed over the outer surface, the indicator ring axially displaceable along the longitudinal axis to engage the tapered flange structure and cause expansion of the indicator ring, the expandable ring rotatable about the longitudinal axis over the outer surface to each of a plurality of selected positions.

2. The apparatus of claim 1 and further comprising a stop structure joined to the cylindrical support, the indicator ring axially displaceable between the stop structure and the tapered flange structure.

3. The apparatus of claim 2 comprises a stop collar joined to the outer surface having an outer diameter greater than the outer diameter of the cylindrical support.

4. The apparatus of claim 3 wherein the indicator ring includes a plurality of notches wherein a notch corresponds to each of the selected positions; and wherein the stop structure is a protrusion selectively engageable with each notch of the plurality of notches.

5. The apparatus of claim 3 wherein the stop structure includes a plurality of notches wherein a notch corresponds to each of the selected positions; and wherein the indicator ring includes a protrusion selectively engageable with each notch of the plurality of notches.

6. The apparatus of claim 3 wherein the indicator ring comprises a split ring.

7. The apparatus of claim 7 wherein the cylindrical support includes a through bore extending along the longitudinal axis.

8. The apparatus of claim 6 wherein the cylindrical support includes an inner bore extending from an end.

9. The apparatus of claim 8 wherein the cylindrical support includes a bottom wall on one end.

10. The apparatus of claim 9 and further comprising a cap replaceably joined to the cylindrical support on an end opposite the bottom wall.

11. The apparatus of claim 8 wherein the cylindrical support, the tapered flange structure and the stop structure are integrally joined together.

12. The apparatus of claim 9 wherein the cylindrical support, the tapered flange structure, the stop collar and the bottom wall are integrally joined together.

13. A last event indicator apparatus comprising:

a cylindrical support having a longitudinal axis, an outer surface and a tapered flange structure, the tapered flange structure having a first end with first diameter and a second diameter that is greater than the first diameter;

a split ring disposed over the outer surface having a first end and a second end with a perimeter edge, the split ring axially displaceable along the longitudinal axis to engage the tapered flange structure with the first end and cause expansion of the split ring, the split ring rotatable about the longitudinal axis over the outer surface to each of a plurality of selected positions; and a stop structure joined to the cylindrical support adjacent the second end of the split ring, the stop structure having a means to engage the perimeter edge of the second end and selectively retain the split ring in each of the plurality of selected positions.

14. The last event indicator apparatus as in claim 13 wherein said means to engage comprises a plurality of space-apart notches formed from the perimeter edge toward the first end, and a protrusion formed on the cylindrical support adapted to selectively engage each notch of the plurality of notches.

15. The last event indicator apparatus as in claim 13 wherein said means to engage comprises a protrusion extending outwardly beyond the perimeter edge of the second end and a plurality of spaced-apart notches formed in the stop collar adapted to selectively receive the protrusion.

16. A last event indicator apparatus for use with a medication container, the apparatus comprising:

a cylindrical support having a through bore along a longitudinal axis, an outer surface and a tapered flange structure, wherein the through bore is of sufficient diameter to receive a portion of the medication container placed therein, and wherein the tapered flange structure has a first end with first diameter and a second diameter that is greater than the first diameter; and an expandable indicator ring disposed over the outer surface, the indicator ring axially displaceable along the longitudinal axis to engage the tapered flange structure and cause expansion of the indicator ring, the expandable ring rotatable about the longitudinal axis over the outer surface to each of a plurality of selected positions.

17. A medication container comprising:

a cylindrical container having a side wall and a bottom wall joined thereto and a longitudinal axis, the side wall having an outer surface with a protrusion and a tapered flange structure spaced apart from the protrusion, the tapered flange structure having a first end with a first diameter and a second diameter that is greater than the first diameter; and an expandable indicator ring disposed over the outer surface having an end forced into selective engagement with the protrusion by the tapered flange at each of a plurality of selected positions, the indicator ring axially displaceable along the longitudinal axis toward the tapered flange a distance to engage the tapered flange structure and cause expansion of the indicator ring and to allow simultaneous rotation of the indicator ring over the outer surface without contacting the protrusion.

18. A medication container comprising:

a cylindrical container having a side wall and a bottom wall joined thereto and a longitudinal axis, the side wall having an outer surface with a portion having a plurality of spaced-apart notches and a tapered flange structure spaced apart from the portion, the tapered flange structure having a first end with a first diameter and a second diameter that is greater than the first diameter; and an expandable indicator ring disposed over the outer surface having an end with a protrusion forced into selective engagement with a notch of the plurality of spaced-apart notches by the tapered flange at each of a plurality of selected positions, the indicator ring axially displaceable along the longitudinal axis toward the tapered flange a distance to engage the tapered flange structure and cause expansion of the indicator ring and to allow simultaneous rotation of the indicator ring over the outer surface without contacting the portion having the plurality of notches.

* * * * *

UNITED STATES PATENT AND TRADEMARK OFFICE

CERTIFICATE OF CORRECTION

PATENT NO. : 5,482,163

DATED : January 9, 1996

INVENTOR(S) : Kenneth L. Hoffman

It is certified that error appears in the above-indentified patent and that said Letters Patent is hereby corrected as shown below:

Column 4, line 33, after "2" add --wherein the stop structure--.

Column 4, line 35, replace "outer" with --first--.

Column 4, line 48, replace "7" with --1--.

Column 5, line 25, replace "collar" with --structure--.

Signed and Sealed this

Eleventh Day of June, 1996

*Attest:*

Bruce Lehman

BRUCE LEHMAN

*Attesting Officer*

*Commissioner of Patents and Trademarks*